US006933434B2

(12) United States Patent
Nishitani et al.

(10) Patent No.: US 6,933,434 B2
(45) Date of Patent: Aug. 23, 2005

(54) MUSICAL TONE CONTROL SYSTEM, CONTROL METHOD FOR SAME, PROGRAM FOR REALIZING THE CONTROL METHOD, MUSICAL TONE CONTROL APPARATUS, AND NOTIFYING DEVICE

(75) Inventors: Yoshiki Nishitani, Hamakita (JP); Satoshi Usa, Hamamatsu (JP); Eiko Kobayashi, Hamakita (JP); Akira Miki, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 52 days.

(21) Appl. No.: 10/140,859

(22) Filed: May 8, 2002

(65) Prior Publication Data

US 2002/0166437 A1 Nov. 14, 2002

(30) Foreign Application Priority Data

May 11, 2001 (JP) ..... 2001-142282

(51) Int. Cl.[7] ..... G10H 4/00

(52) U.S. Cl. ..... 84/615; 84/653; 84/612; 84/636; 84/652; 84/668; 84/609; 84/649

(58) Field of Search ..... 84/600–609, 3, 84/615, 653, 612, 636, 652, 668, 649; 446/409, 175, 5, 571

(56) References Cited

U.S. PATENT DOCUMENTS

| | | | | |
|---|---|---|---|---|
| 4,359,723 A | * | 11/1982 | Cohen | 340/573 |
| 4,614,145 A | | 9/1986 | Chibana | |
| 4,662,260 A | * | 5/1987 | Rumsey | 84/600 |
| 4,737,134 A | * | 4/1988 | Rumsey | 446/409 |
| 5,027,688 A | | 7/1991 | Suzuki et al. | |
| 5,046,394 A | | 9/1991 | Suzuki et al. | |
| 5,058,480 A | | 10/1991 | Suzuki et al. | |
| 5,177,311 A | | 1/1993 | Suzuki et al. | |
| 5,290,964 A | | 3/1994 | Hiyoshi et al. | |
| 5,313,010 A | | 5/1994 | Matsushima et al. | |
| 5,512,703 A | | 4/1996 | Usa | |
| 5,585,584 A | | 12/1996 | Usa | |
| 5,648,627 A | | 7/1997 | Usa | |
| 5,663,514 A | | 9/1997 | Usa | |
| 6,550,426 B2 | * | 4/2003 | Tsengas | 119/707 |
| 2001/0015123 A1 | | 8/2001 | Nishitani et al. | |

FOREIGN PATENT DOCUMENTS

| | | |
|---|---|---|
| EP | 0570999 A2 | 11/1993 |
| EP | 1195742 A2 | 4/2002 |
| JP | 09-127937 | 5/1997 |

* cited by examiner

*Primary Examiner*—Marlon T. Fletcher
*Assistant Examiner*—David Warren
(74) *Attorney, Agent, or Firm*—Harness, Dickey & Pierce, P.L.C.

(57) ABSTRACT

There is provided a musical tone control system which is capable of preventing control not intended by the user even when the user stops moving when controlling the generation of musical tones reflecting motion or physical posture of the user. A motion detecting device capable of being carried by an operator generates a detected motion signal corresponding to motion of the operator carrying the device, and transmits same to an external device. A musical tone generating device generates musical tones. A control device receives the detected motion signal transmitted from the motion detecting device and controls generation of musical tones from the musical tone generating device based on the received detected motion signal. The control device determines whether the operator is in a moving state based on the received detected motion signal, and when determining that the operator is not in the moving state, performs control to stop the generation of musical tones from the musical tone generating device after a predetermined time period elapses after the determination is made.

9 Claims, 7 Drawing Sheets

MUSICAL TONE CONTROL SYSTEM, CONTROL METHOD FOR SAME, PROGRAM FOR REALIZING THE CONTROL METHOD, MUSICAL TONE CONTROL APPARATUS, AND NOTIFYING DEVICE

BACKGROUND OF THE INVENTION

1. Field of the Invention

The present invention relates to a musical tone control system, a control method for the same, a program for realizing the control method, a musical tone control apparatus, and a notifying device, which control musical tone generation in a manner reflecting motion or physical posture of a user.

2. Description of the Related Art

Audio systems and other musical tone generating apparatuses can generate desired musical tones once four performance parameters of tone color, pitch, volume, and effects are determined. MIDI (Musical Instrument Digital Interface) musical instruments and other musical tone generating apparatuses perform music based on music data. Users adjust the volume and other performance parameters by knobs, buttons, etc. of the MIDI musical instruments.

As described above, in MIDI musical instruments and other musical tone generating apparatuses, the desired volume etc. are obtained by the user suitably operating knobs or other operating elements. When a user listens to music performed by a musical tone generating apparatus at a desired volume etc., the method of adjustment of the performance parameters by control knobs is effective. In the conventional musical tone generating apparatuses, however, while it is possible to provide the user with faithful performance or reproduction of music based on music data, it is not possible to provide the user with the pleasure of actively participating in the reproduction of the music.

Therefore, a system may be considered in which motion sensors are attached to the body of the user, movement of the body of the user is detected by these sensors, and music is played based on the results of the detection. By using such a system, it is possible to control the performance of music based on MIDI data etc. in accordance with motion of the user rather than having the user dance or otherwise move in accordance with the music and to thereby provide the user with a new form of participatory musical entertainment.

In such a system detecting motion of the user and performing music based on music data in accordance with the results of detection, however, sometimes the performance of music was obstructed when the user stopped moving his or her body due to fatigue or the like. For example, MIDI data is data for generating musical tones by note-on-event data and stopping the generation of musical tones by note-off-event data. Therefore, when controlling the performance of music by sequentially executing events in accordance with MIDI event data corresponding to motion of the operator, the note-off-event data of the MIDI data is not output when the user stops moving in the middle of the music and therefore musical tones generated by note-on-event data of a certain pitch are continuously output as they are. To prevent the problem of musical tones being thus continuously output even after the user stops moving, it may be considered to perform control so as to automatically stop generation of all musical tones at the point of time when the user stops moving, thereby stopping the reproduction of the music. When the music played includes a portion where a beat timing motion is stopped in the middle or end of the music as expressed by a "fermata" mark, however, regardless of the user deliberately stopping motion in order to control the performance of the music, all musical tones are automatically suddenly stopped and the reproduction of music is terminated, i.e., control unintended by the user is performed.

SUMMARY OF THE INVENTION

It is an object of the present invention to provide a musical tone control system, a control method for the same, a program for realizing the control method, a musical tone control apparatus, and a notifying device, which are capable of preventing control not intended by the user even when the user stops moving when controlling the generation of musical tones reflecting motion or physical posture of the user.

To attain the above object, in a first aspect of the present invention, there is provided a musical tone control system comprising a motion detecting device capable of being carried by an operator, the motion detecting device generating a detected motion signal corresponding to motion of the operator carrying the device, and transmitting same to an external device, a musical tone generating device that generates musical tones, and a control device that receives the detected motion signal transmitted from the motion detecting device and controls generation of musical tones from the musical tone generating device based on the received detected motion signal, wherein the control device determines whether the operator is in a moving state based on the received detected motion signal, and when determining that the operator is not in the moving state, performs control to stop the generation of musical tones from the musical tone generating device after a predetermined time period elapses after the determination is made.

To attain the above object, in a second aspect of the present invention, there is provided a musical tone control system comprising a motion detecting device capable of being carried by an operator, the motion detecting device generating a detected motion signal corresponding to motion of the operator carrying the device, and transmitting same to an external device, a musical tone generating device that generates musical tones, and a control device that receives the detected motion signal transmitted from the motion detecting device and controls generation of musical tones from the musical tone generating device based on the received detected motion signal, wherein the control device determines whether the operator is in a moving state based on the received detected motion signal, and performs control to stop the generation of musical tones from the musical tone generating device when it determines that the operator has not moved for a predetermined time period.

According to the first and second aspects of the present invention, when motion of an operator is detected by a motion detecting device and generation of musical tones is controlled based on a detected motion signal transmitted from that motion detecting device, the generation of musical tones is stopped when it is determined that the operator has not moved for a predetermined time period or after a predetermined time period elapses after it is determined that the operator has not moved based on the detected motion signal transmitted from the motion detecting device. As a result, it is possible to prevent generation of musical tones from being stopped immediately when the operator temporarily stops moving deliberately in order to control the generation of musical tones, or to prevent the generation of musical tones from being continuously generated in spite of the user stopping motion. Thus, control of musical tones not intended by the user can be prevented.

To attain the above object, in a third aspect of the present invention, there is provided a musical tone control system comprising a motion detecting device capable of being carried by an operator, the motion detecting device generating a detected motion signal corresponding to motion of the operator carrying the device, and transmitting same to an external device, a musical tone generating device that generates musical tones, a control device that receives the detected motion signal transmitted from the motion detecting device and controls generation of musical tones from the musical tone generating device based on the received detected motion signal, and a notifying device that determines whether the operator is in a moving state based on the detected motion signal received from the control device and when determining that the operator is not in the moving state, notifies the operator of the determination that the operator is not in the moving state after a predetermined time period elapses after the determination is made.

To attain the above object, in a fourth aspect of the present invention, there is provided a musical tone control system comprising a motion detecting device capable of being carried by an operator, the motion detecting device generating a detected motion signal corresponding to motion of the operator carrying the device, and transmitting same to an external device, a musical tone generating device that generates musical tones, a control device that receives the detected motion signal transmitted from the motion detecting device and controls generation of musical tones from the musical tone generating device based on the received detected motion signal, and a notifying device that determines whether the operator is in a moving state based on the detected motion signal received by the control device and when determining that the operator has not been in the moving state for a predetermined time period, notifies the operator of the determination.

Preferably, in the third and second aspects, the control device is responsive to the notification that the operator is not in the moving state from the notifying device, for performing control to stop the generation of the musical tone from the musical tone generating device, and for performing control to resume the generation of musical tones from the musical tone generating device after a predetermined time period elapses from the stoppage of generation of musical tones.

More preferably, in the third and second aspects, the control device controls the musical tone generating device so as to gradually raise performance tempo after the resumption of generation of musical tones.

According to the third and fourth aspects of the present invention, when motion of an operator is detected by a motion detecting device and generation of musical tones is controlled based on a detected motion signal transmitted from that motion detecting device, it is possible to notify the operator that he or she has stopped moving when it is determined that the operator has not moved for a predetermined time period or after a predetermined time period elapses after it is determined that the operator has not moved, based on the detected motion signal transmitted from the motion detecting device. As a result, it is possible to prevent the generation of musical tones from being suddenly stopped when the operator is not aware that he or she has stopped moving. Thus, control of musical tones not intended by the operator can be prevented, and further it is possible to prompt the user to resume motion.

To attain the above object, in a fifth aspect of the present invention, there is provided a musical tone control system comprising a motion detecting device capable of being carried by an operator, the motion detecting device generating a detected motion signal corresponding to motion of the operator carrying the device, and transmitting same to an external device, a musical tone generating device that generates musical tones, a control device that receives the detected motion signal transmitted from the motion detecting device and controls generation of musical tones from the musical tone generating device based on the received detected motion signal, a notifying device that determines whether the operator is in a moving state based on the detected motion signal received by the control device and when determining that the operator is not in the moving state, notifies the operator of the determination, and a setting device that sets on/off states of first, second, third, and fourth control modes for controlling the control device and the notifying device, wherein when the first control mode is set on by the setting device, the control device determines whether the operator is in a moving state based on the received detected motion signal, and when determining that the operator is not in the moving state, performs control to stop the generation of musical tones from the musical tone generating device after a first predetermined time period elapses after the determination is made; when the second control mode is set on by the setting device, the control device determines whether the operator is in the moving state based on the received detected motion signal, and when determining that the operator has not been in the moving state for a second predetermined time period, performs control to stop the generation of musical tones from the musical tone generating device; when the third control mode is set on by the setting device, the notifying device determines whether the operator is in the moving state based on the detected motion signal received by the control device, and when determining that the operator is not in the moving state, notifies the operator of the determination after a third predetermined time period elapses after the determination is made; and when the fourth control mode is set on by the setting device, the notifying device determines whether the operator is in the moving state based on the detected motion signal received by the control device, and when determining that the operator has not been in the moving state for a fourth predetermined time period, notifies the operator of the determination.

To attain the above object, in a sixth aspect of the present invention, there is provided a musical tone control system comprising a human body state detecting device capable of being carried by an operator, the human body state detecting device detecting a physical state of the user wearing the device, and transmitting a detected human body state signal to an external device, a musical tone generating device that generates musical tones, and a control device that receives the detected human body state signal transmitted from the human body state detecting device and controls generation of musical tones from the musical tone generating device based on the received detected human body state signal, wherein the control device determines whether the physical state of the operator indicated by the received detected human body state signal is in a predetermined state, and when determining that the physical state is in the predetermined state, performs control to stop the generation of musical tones from the musical tone generating device after a predetermined time period elapses after the determination is made.

To attain the above object, in a seventh aspect of the present invention, there is provided a musical tone control system comprising a human body state detecting device capable of being carried by an operator, the human body state detecting device detecting a physical state of the operator wearing the device, and transmitting a detected human body state signal to an external device, a musical tone generating device that generates musical tones, a control device that receives the detected human body state signal transmitted from the human body state detecting device and controls generation of musical tones from the musical tone generating device based on the received detected human body state signal, and a notifying device that determines whether the physical state of the operator indicated by the detected human body state signal received by the control device is in a predetermined state, and when determining that the operator is not in the predetermined state, notifies the operator of the determination after a predetermined time period elapses after the determination is made.

To attain the above object, in an eighth aspect of the present invention, there is provided a musical tone control apparatus comprising a musical tone generating device that generates musical tones, and a control device that receives a detected motion signal corresponding to motion of an operator and controls generation of musical tones from the musical tone generating device based on the received detected motion signal, wherein the control device determines whether the operator is in a moving state based on the received detected motion signal, and when determining that the operator is not in the moving state, performs control to stop the generation of musical tones from the musical tone generating device after a predetermined time period elapses after the determination is made.

To attain the above object, in a ninth aspect of the present invention, there is provided a musical tone control apparatus comprising a musical tone generating device that generates musical tones, and a control device that receives a detected motion signal corresponding to motion of an operator and controls generation of musical tones from the musical tone generating device based on the received detected motion signal, wherein the control device determines whether the operator is in a moving state based on the received detected motion signal, and performs control to stop the generation of musical tones from the musical tone generating device when it determines that the operator has not been in the moving state for a predetermined time period.

To attain the above object, in a tenth aspect of the present invention, there is provided a notifying device comprising a device that receives a detected motion signal corresponding to motion of an operator, determines whether the operator is in a moving state based on the received detected motion signal, and when determining that the operator is not in the moving state, notifies the operator of the determination after a predetermined time period elapses after the determination is made.

To attain the above object, in an eleventh aspect of the present invention, there is provided a notifying device comprising a device that receives a detected motion signal corresponding to motion of an operator, determines whether the operator is in a moving state based on the received detected motion signal, and when determining that the operator has not been in the moving state for a predetermined time period, notifies the operator of the determination.

To attain the above object, in a twelfth aspect of the present invention, there is provided a method of controlling a musical tone control system comprising a control step of receiving a detected motion signal transmitted from a motion detecting device capable of being carried by an operator, the motion detecting device generating a detected motion signal corresponding to motion of the operator carrying the device and transmitting same to an external device, and controlling generation of musical tones from a musical tone generating device based on the received detected motion signal, wherein in the control step it is determined that the operator is in a moving state based on the received detected motion signal, and when it is determined that the operator is not in the moving state, control is performed to stop the generation of musical tones from the musical tone generating device after a predetermined time period elapses after the determination is made.

To attain the above object, in a thirteenth aspect of the present invention, there is provided a method of controlling a musical tone control system, comprising a control step of receiving a detected motion signal transmitted from a motion detecting device capable of being carried by an operator, the motion detecting device generating a detected motion signal corresponding to motion of the operator carrying the device and transmitting same to an external device, and controlling generation of musical tones from a musical tone generating device based on the received detected motion signal, wherein in the control step it is determined whether the operator is in a moving state based on the received detected motion signal, and when it is determined that the operator has not been in the moving state for a predetermined time period, control is performed to stop the generation of musical tones from the To attain the above object, in a fourteenth aspect of the present invention, there is provided a method of controlling a musical tone control system, comprising a control step of receiving a detected motion signal transmitted from a motion detecting device capable of being carried by an operator, the motion detecting device generating a detected motion signal corresponding to motion of the operator carrying the device, and transmitting same to an external device, and controlling generation of musical tones from a musical tone generating device based on the received detected motion signal, and a notifying step of determining whether the operator is in a moving state based on the detected motion signal received in the control step, and when determining that the operator is not in the moving state, notifying the operator of the determination that the operator is not in the moving state after a predetermined time period elapses after the determination is made.

To attain the above object, in a fifteenth aspect of the present invention, there is provided a method of controlling a musical tone control system, comprising a control step of receiving a detected motion signal transmitted from a motion detecting device capable of being carried by an operator, the motion detecting device generating a detected motion signal corresponding to motion of the operator carrying the device, and transmitting same to an external device, and controlling generation of musical tones from a musical tone generating device based on the received detected motion signal, and a notifying step of determining whether the operator is in a moving state based on the detected motion signal received in the control step, and when determining that the operator has not been in the moving state for a predetermined time period, notifying the operator of the determination.

To attain the above object, in a sixteenth aspect of the present invention, there is provided a method of controlling a musical tone control system, comprising a control step of receiving a detected motion signal transmitted from a motion detecting device capable of being carried by an operator, the motion detecting device generating a detected motion signal corresponding to motion of the operator carrying the device, and transmitting same to an external device, and controlling generation of musical tones from a musical tone generating device based on the received detected motion signal, and a notifying step of determining whether the operator is in a moving state based on the detected motion signal received by the control step, and when determining that the operator is not in the moving state, notifying the operator of the determination, wherein when a first control mode is set on by a setting device that sets on/off states of the first control mode, and second, third, and fourth control modes for controlling the control step and the notifying step, in the control step it is determined whether the operator is in a moving state based on the received detected motion signal, and when it is determined that the operator is not in the moving state, control is performed to stop the generation of musical tones from the musical tone generating device after a first predetermined time period elapses after the determination is made; when the second control mode is set on by the setting device, in the control step it is determined whether the operator is in the moving state based on the received detected motion signal, and when it is determined that the operator has not been in the moving state for a second predetermined time period, control is performed to stop the generation of musical tones from the musical tone generating device; when the third control mode is set on by the setting device, in the alarm step it is determined whether the operator is in the moving state based on the detected motion signal received in the control step, and when it is determined that the operator is not in the moving state, the operator is notified of the determination after a third predetermined time period elapses after the determination is made; and when the fourth control mode is set on by the setting device, in the alarm step it is determined whether the operator is in the moving state based on the detected motion signal received in the control step, and when it is determined that the operator has not been in the moving state for a fourth predetermined time period, the operator is notified of the determination.

To attain the above object, in a seventeenth aspect of the present invention, there is provided a method of controlling a musical tone control system, comprising a control step of receiving a detected human body state signal transmitted from a human body state detecting device capable of being carried by an operator, the human body state detecting device detecting a physical state of the operator wearing the device, and transmitting a detected human body state signal to an external device, and controlling generation of musical tones from a musical tone generating device based on the received detected human body state signal, wherein in the control step it is determined whether the physical state of the operator indicated by the received detected human body state signal is in a predetermined state, and when it is determined that the physical state is in the predetermined state, control is performed to stop the generation of musical tones from the musical tone generating device after a predetermined time period elapses after the determination is made.

To attain the above object, in an eighteenth aspect of the present invention, there is provided a method of controlling a musical tone control system, comprising a control step of receiving a detected human body state signal transmitted from a human body state detecting device capable of being carried by an operator, the human body state detecting device detecting a physical state of the operator wearing the device, and transmitting a detected human body state signal to an external device, and controlling generation of musical tones from the musical tone generating device based on the received detected human body state signal, and a notifying step of determining whether the physical state of the operator indicated by the detected human body state signal received in the control step is in a predetermined state, and when determining that the physical state is not in the predetermined state, notifying the operator of the determination after a predetermined time period elapses from the determination.

To attain the above object, in nineteenth to twenty-fifth aspects of the present invention, there are provided programs for causing a computer to execute the methods according to the twelfth to eighteenth aspects of the present invention, respectively.

The above and other objects, features and advantages of the invention will become more apparent from the following detailed description taken in conjunction with the accompanying drawings.

DESCRIPTION OF THE PREFERRED EMBODIMENTS

Preferred embodiments of the present invention will now be described in detail with reference to the accompanying drawings.

Figure 1:
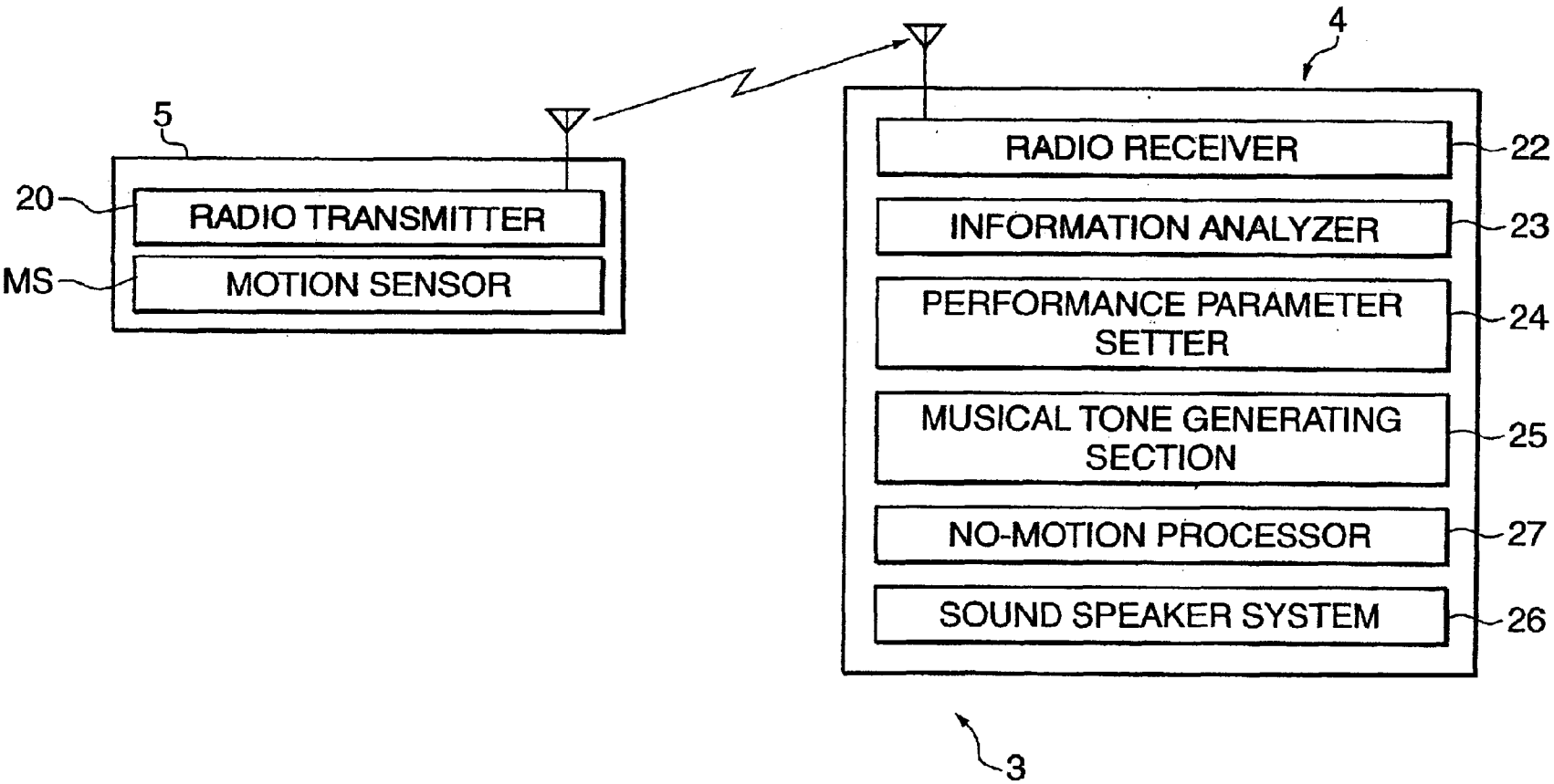
FIG. 1 is a block diagram of the schematic configuration of functions of a musical tone generating system according to an embodiment of the present invention.

First, FIG. 1 is a view of the schematic functional configuration of a musical tone generating system according to an embodiment of the present invention. As shown in the figure, the musical tone generating system (musical tone control system) 3 is provided with a musical tone generating apparatus 4 and a motion detecting terminal 5.

The motion detecting terminal 5 is a portable terminal which can be carried by a user, for example, held in the hand by the user or attached to part of his or her body. The motion detecting terminal 5 is carried by the user when used, and is provided with a motion sensor MS for detecting the motion of the user carrying it and generating a detected motion signal. Here, as the motion sensor MS, it is possible to use a three-dimensional acceleration sensor, a three-dimensional velocity sensor, a two-dimensional acceleration sensor, a two-dimensional velocity sensor, a strain detector, or various other known motion sensors.

The motion detecting terminal 5 carries a radio transmitter 20 for radio transmitting data to the musical tone generating apparatus 4. The radio transmitter 20 sequentially radio transmits a detected motion signal corresponding to motion of the user generated by the motion sensor MS in the above way to the musical tone generating apparatus 4.

The musical tone generating apparatus 4 is comprised of a radio receiver 22, an information analyzer 23, a performance parameter determining section 24, a musical tone generating section 25, a no-motion processor 27, and a sound speaker system 26.

The radio receiver 22 receives the detected motion signal radio transmitted from the motion detecting terminal 5 and outputs the received detected motion signal to the information analyzer 23. The information analyzer 23 performs predetermined processing to analyze the motion information supplied by the radio receiver 22 and outputs the results of analysis to the performance parameter determining section 24.

The performance parameter determining section 24 sets performance parameters for the musical tones in accordance with the results of analysis of motion data supplied from the information analyzer 23, for example, the volume, tempo, and other parameters of the musical tones. The musical tone generating section 25 generates a musical tone signal based on music data (for example, MIDI data) stored in advance. When generating such musical tone signal, the musical tone generating section 25 adjusts the musical tone signal in accordance with the performance parameters of the musical tones determined by the performance parameter determining section 24 and outputs the adjusted musical tone signal to the sound speaker system 26. The sound speaker system 26 outputs musical tones in accordance with the adjusted musical tone signal supplied from the musical tone generating section 25 to thereby perform music. The no-motion processor 27 determines whether the user carrying the motion detecting terminal 5 is moving from the results of analysis of the information analyzer 23, and performs processing for control to stop the generation of musical tones when the operator is not in the moving state.

By being provided with the above functions, the musical tone generating system 3 can perform original music reflecting the motion of the user carrying the motion detecting terminal 5 rather than simply performing or reproducing music faithful to music data. Next, the configurations of the motion detecting terminal 5 and the musical tone generating apparatus 4 for realizing these functions will be described in detail.

Figure 2:
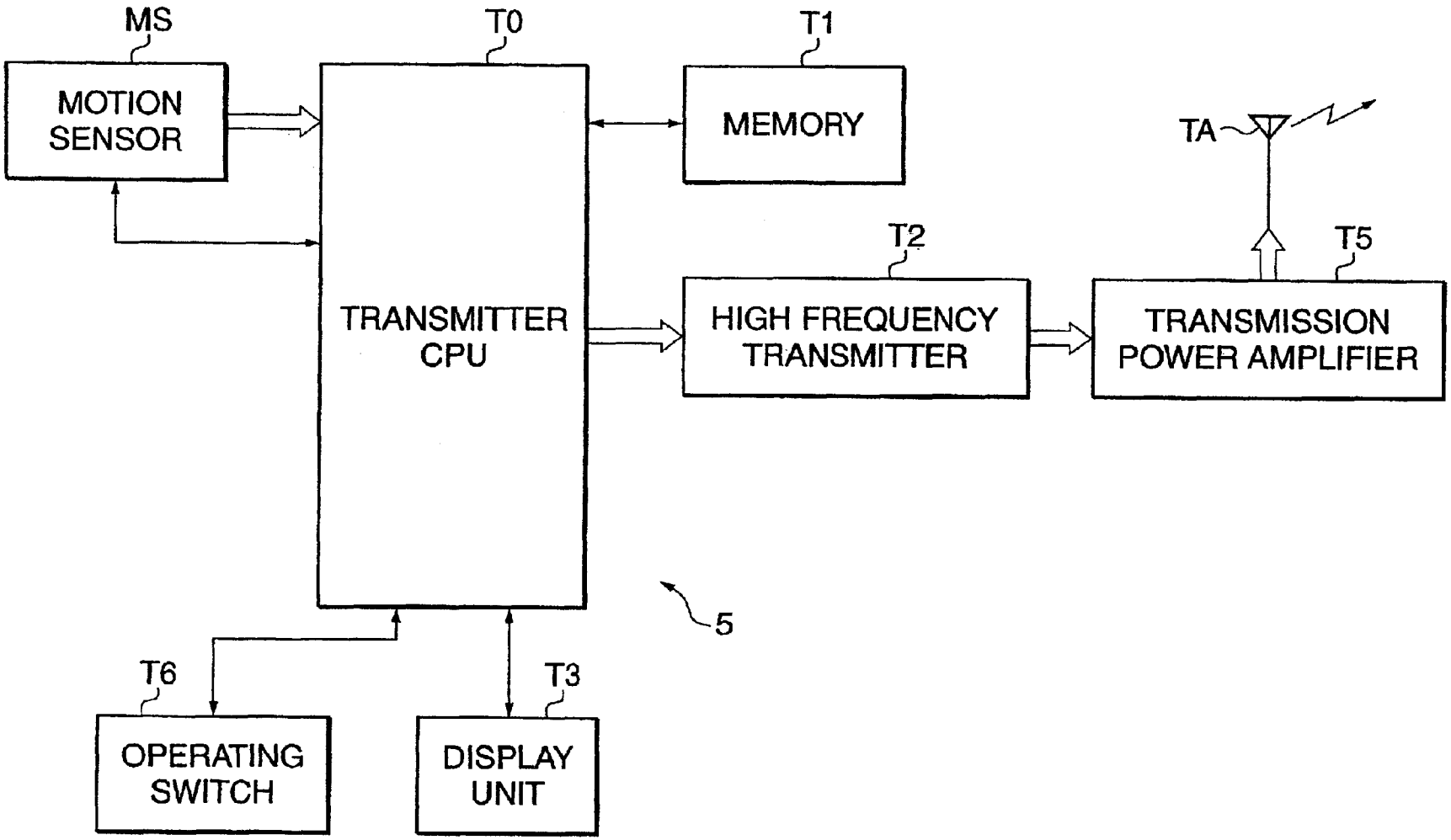
FIG. 2 is a block diagram of an example of the hardware configuration of a motion detecting terminal of part of the musical tone generating system of FIG. 1.

FIG. 2 is a block diagram of an example of the configuration of the motion detecting terminal 5. As shown in the figure, the motion detecting terminal 5 is provided with a signal processor and a transmitter in addition to the motion sensor MS. The signal processor and transmitter are comprised of a transmitter central processing unit (transmitter CPU) T0, memory T1, high frequency transmitter T2, display unit T3, transmission power amplifier T5, operating switch T6, etc. The motion sensor MS is structured to enable it to be held by the play participant, that is, the user, in the hand or be attached to any location of the body of the user. Details of an example of the appearance and structure will be described later. For example, when making the motion sensor MS a hand held type, the signal processor and transmitter can be built into the sensor housing together with the motion sensor MS (see FIG. 3).

The transmitter CPU T0 controls the motion sensor MS, high frequency transmitter T2, and display unit T3 based on a transmitter operation program stored in the memory T1. The detected motion signal from the motion sensor MS is subjected to predetermined processing such as processing for assignment of an ID number by the transmitter CPU T0, is transmitted to the high frequency transmission T2, is amplified by the transmission power amplifier T5, and then is radio transmitted to the musical tone generating apparatus 4 side through a transmission antenna TA. That is, the transmitter CPU T0, memory T1, high frequency transmitter T2, transmission power amplifier T5, and transmission antenna TA form the radio transmitter 20 shown in FIG. 1. Note that the ID number is assigned by the transmitter CPU T0 so as to enable the musical tone generating apparatus 4 to identify from which motion detecting terminal 5 a detected motion signal was outputted in the case where a plurality of motion detecting terminals 5 are used. If the system is configured using only a single motion detecting terminal 5, the processing for assigning an ID number can be omitted.

The display unit T3 is for example provided with a seven-segment type light emitting diode (LED) or liquid crystal display (LCD) or one or more LED lights and displays various information such as the sensor number, operation on/off state, and power alarm. The operating switch T6 is used for turning the power of the motion detecting terminal 5 on and off, setting the mode, and other settings. These parts are supplied with drive power from a battery power unit, not shown. As this battery power unit, it is possible to use a primary cell or to use a rechargeable secondary cell.

Figure 3:
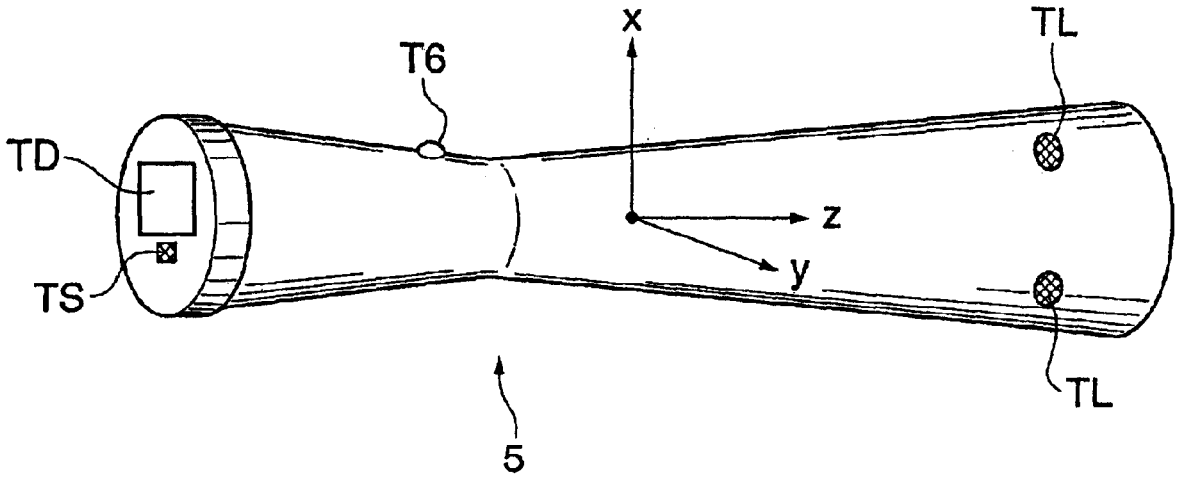
FIG. 3 is a view of the appearance of the motion detecting terminal of FIG. 2.

FIG. 3 is a view of an example of the appearance of the motion detecting terminal 5. The motion detecting terminal 5 shown in FIG. 3 is a baton-shaped hand held type. The motion detecting terminal 5 houses the various parts shown in FIG. 2 except for the operation section and the display unit. As the built-in motion sensor MS, for example, a three-dimensional acceleration sensor, three-dimensional velocity sensor, or other three-dimensional sensor can be used. By the play participant holding and operating this motion detecting terminal 5, it is possible to output a detected motion signal corresponding to the direction, magnitude, and speed of the operation.

As shown in FIG. 3, the motion detecting terminal 5 has a larger diameter at the two ends and is tapered with a smaller diameter at the center and consists of a base part (illustrated at the left) and an end part (illustrated at the right). The base part has an average diameter smaller than the end part and can be easily gripped by the hand to function as a grip. At the outer surface of the bottom (left end in illustration) are provided an LED display TD of the display unit T3 and a power switch TS of the battery power source. At the outer surface of the center, an operating switch T6 is provided. Near the front end of the end part are provided a plurality of LED lights of the display unit T3.

The baton-shaped motion detecting terminal 5 shown in FIG. 3 outputs a signal corresponding to the direction of operation and operating force from the built-in motion sensor MS when the play participant holds the handle of the baton and operates it. For example, when a three-dimensional acceleration sensor as the motion sensor MS is built in the terminal with its x-axis direction detection axis aligned with the direction of attachment of the operating switch T6, if the motion detecting terminal 5 is held with the attachment position of the operating switch T6 up and swung up and down, an output signal indicating the x-axis direction acceleration $\alpha x$ corresponding to the swing acceleration (force) is generated. If the motion detecting terminal 5 is swung left and right (direction perpendicular to paper surface), an output signal indicating the y-axis direction acceleration $\alpha y$ corresponding to the swing acceleration (force) is generated. If the motion detecting terminal 5 is thrust forward or pulled back (left-right direction of the paper surface), an output signal indicating the z-axis direction acceleration $\alpha z$ corresponding to the thrust acceleration or pullback acceleration is generated. Such generated output signals, that is, detected motion signals, are transmitted to the musical tone generating apparatus 4 by the above radio transmission function.

Note that the motion detecting terminal 5 is not limited to such a baton shape to be held in the hand of the user and may also be of a type attached to the arm or leg using a band etc. That is, any shape or method of attachment to the user may be used.

Figure 4:
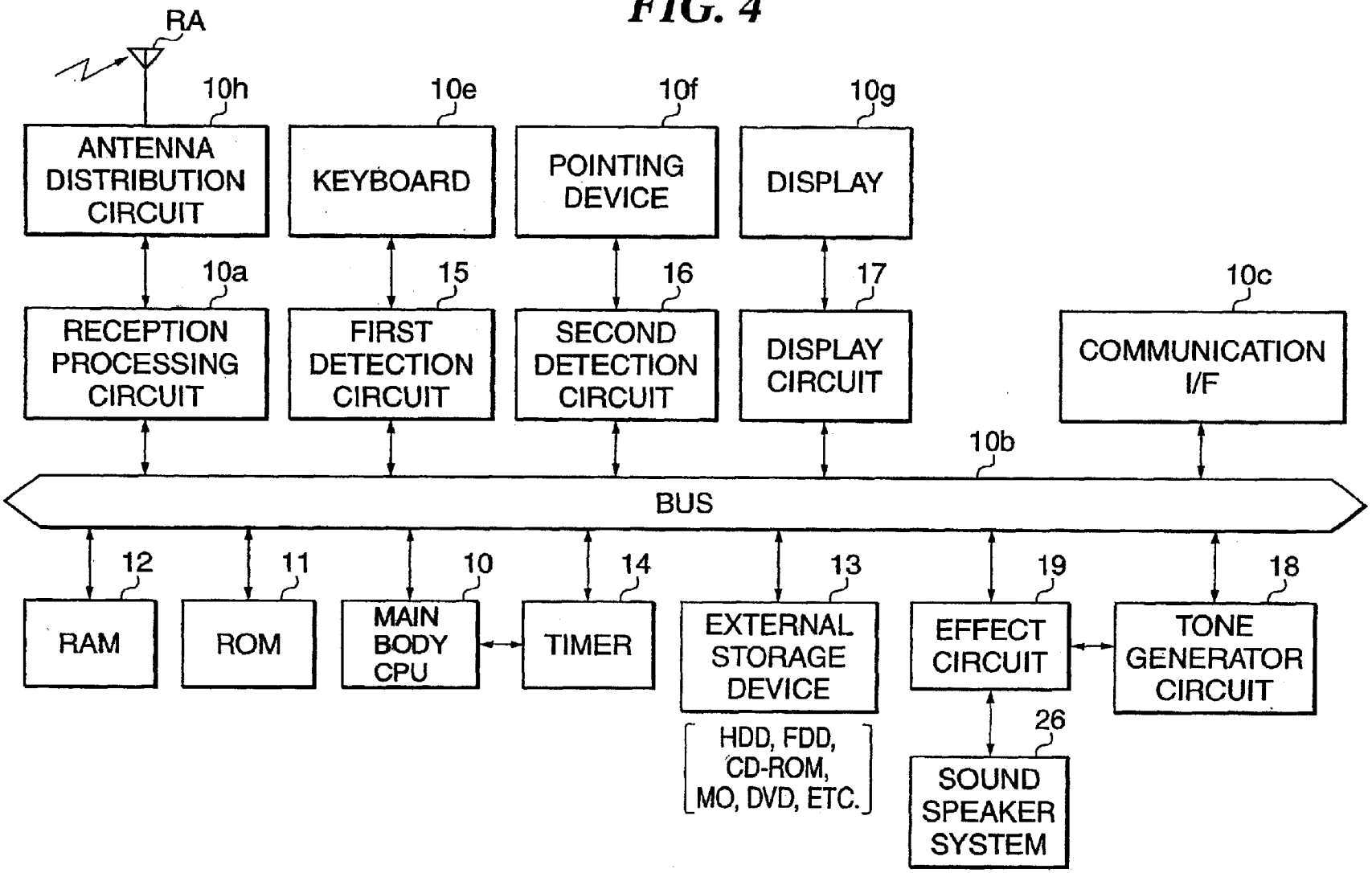
FIG. 4 is a block diagram of an example of the hardware configuration of a musical tone generating apparatus of part of the musical tone generating system of FIG. 1.

FIG. 4 is a block diagram of an example of the hardware configuration of the musical tone generating apparatus 4. As shown in FIG. 4, the musical tone generating apparatus 4 is comprised of a main body central processing unit (main body CPU) 10, a read only memory (ROM) 11, a random access memory (RAM) 12, an external storage device 13, a timer 14, first and second detection circuits 15 and 16, a display circuit 17, a tone generator circuit 18, an effect circuit 19, a reception processing circuit 10*a*, etc. These parts 10 to 10*a* are connected through a bus 10*b*.

The main body CPU 10 that controls the musical tone generating apparatus 4 as a whole performs various control in accordance with predetermined programs under the time control of the timer 14 used for generating a tempo clock or interruption clock. It centrally executes performance processing control programs relating to determination of performance parameters, change of performance data, control of reproduction, and control at the time of absence of motion. The ROM 11 stores predetermined control programs for controlling the musical tone generating apparatus 4. These control programs contain performance processing programs relating to determination of performance parameters, change of performance data, control of reproduction, and control at the time of absence of motion, various data/tables, etc. The RAM 12 is used as a work area for storing data or parameters needed for such processing and temporarily storing various data being processed.

A keyboard 10*e* is connected to the first detection circuit 15, a mouse or other pointing device 10*f* is connected to the second detection circuit 16, and a display 10*g* is connected to the display circuit 17. The keyboard 10*e* or pointing device 10*f* may be operated while viewing various screens displayed on the display 10*g* so as to set various modes required for control of the performance data at the musical tone generating apparatus 4, assign processing or functions corresponding to ID numbers identifying the plurality of motion detecting terminals 5 when there are a plurality of such motion detecting terminals 5, and set tone colors (sound source) and various other settings for the performance tracks.

An antenna distribution circuit 10*h* is connected to the reception processing circuit 10*a*. The antenna distribution circuit 10*h* is for example comprised of a multichannel high frequency receiver and receives detected motion signals radio transmitted from a plurality of motion detecting terminals 5 through a reception antenna RA. The reception processing circuit 10*a* converts the received signal to data that can be processed by the musical tone generating apparatus 4, introduces it into the apparatus, and stores it in a predetermined area of the RAM 12. That is, the reception processing circuit 10*a*, the antenna distribution circuit 10*h*, and reception antenna RA by the radio receiver 22 shown in FIG. 1.

The main body CPU 10 performs processing for play or performance in accordance with the above-mentioned control programs, analyzes the detected motion signal indicating the physical motion of the user holding the motion detecting terminal 5, and determines the performance parameters based on the results of the analysis. Further, the main body CPU 10 performs special processing for control when determining from the results of analysis of the detected motion signal supplied from the motion detecting terminal 5 that the operator is not in the moving state, that is, when detecting the absence of motion. That is, the main body CPU 10 etc. form the information analyzer 23 and the performance parameter determining section 24 shown in FIG. 1. Note that details of the processing for determining the performance parameters and the processing at the time of absence of motion will be described later.

The effect circuit 19 formed by a digital signal processor (DSP) etc. realizes the functions of the musical tone generating section 25 shown in FIG. 1 together with the tone generator circuit 18 and main body CPU 10 and generates performance data processed in accordance with motion of the play participant by control of the performance data based on the determined performance parameters. The sound speaker system 26 outputs the musical tones played in accordance with the musical tone signal based on the processed performance data.

The external storage device 13 is comprised of a hard disk drive (HDD), compact disk read-only memory (CD-ROM) drive, floppy disk drive (FDD), magneto-optic (MO) disk drive, digital versatile disk (DVD) drive, or other storage device and can store various types of data such as various control programs or music data. Therefore, it is possible to read the programs or various data etc. required for determination of performance parameters, change of performance data, control of reproduction, and control at the time of absence of motion not only using the ROM 11, but also from the external storage device 13 to the RAM 12 and if necessary store the processing results in the external storage device 13.

As described above, in the musical tone generating system 3, the information analyzer 23 performs predetermined processing for analysis of the detected motion signals from the motion detecting terminals 5 received by the radio receiver 22, while the performance parameter determining section 24 determines the performance parameters based on the results of analysis. Here, how the detected motion signals should be analyzed, and which of the performance parameters should be the results of analysis may be decided arbitrarily. These may be suitably set in accordance with the shape and type of the motion detecting terminal 5 used (baton-shaped type or type attached to leg etc.), the type of the motion sensor MS carried by the motion detecting terminal 5 (two-dimensional sensor or three-dimensional sensor), etc. Below, however, a explanation will be given of the example of processing for analysis and processing for determination of parameters when using a three-dimensional sensor as the motion sensor MS.

Figure 5:
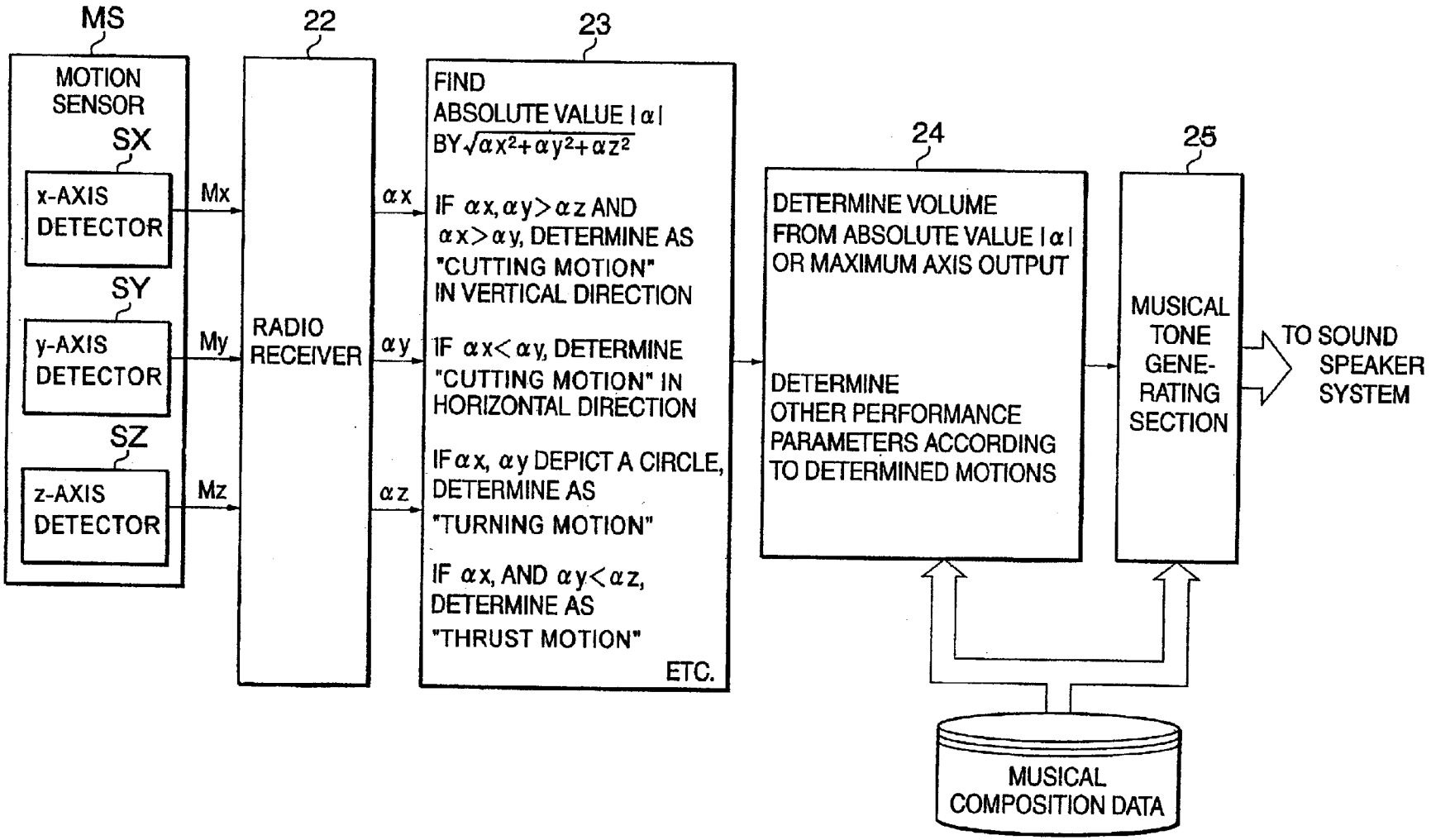
FIG. 5 is a view useful in explaining an example of processing for analysis and processing for determining parameters according to the musical tone generating system of FIG. 1.

FIG. 5 is a block diagram of the functions when using a three-dimensional sensor for directing the play of music. In the case of use of a three-dimensional sensor, the three-dimensional sensor is built in as a motion sensor MS carried in the baton-shaped motion detecting terminal 5 described above with reference to FIG. 3. It is possible to output detected motion signals corresponding to the direction of operation and force of operation by the user operating such motion detecting terminals 5 held in one or both hands.

Here, when using a three-dimensional acceleration sensor as the three-dimensional sensor, signals Mx, My, and Mz indicating the x-axis (vertical) direction acceleration $\alpha x$, y-axis (left-right) direction acceleration $\alpha y$, and z-axis (front-back) direction acceleration $\alpha z$ are radio transmitted from the x-axis detector SX, y-axis detector SY, and z-axis detector SZ of the motion sensor MS of each motion detecting terminal 5 to the musical tone generating apparatus 4 with ID numbers of each motion detecting terminal 5 assigned to the signals Mx, My, and Mz, respectively. When the musical tone generating apparatus 4 confirms that present ID numbers have been assigned to these signals, the acceleration data indicative of acceleration along the respective axes are output to the information analyzer 23 through the radio receiver 22.

The information analyzer 23 analyzes the acceleration data for each axis. It first finds the absolute value $|\alpha|$ of the acceleration expressed by formula (1):

$$|\alpha|=(\alpha x*\alpha x+\alpha y*\alpha y+\alpha z*\alpha z)^{1/2} \quad (1)$$

Next, the information analyzer 23 compares the accelerations $\alpha x$ and $\alpha y$ and the acceleration $\alpha z$. For Example, when $\alpha x<\alpha z$ and $\alpha y<\alpha z$ hold, that is, when the z-axis direction acceleration $\alpha z$ is larger than the x- and y-axis direction accelerations $\alpha x$ and $\alpha y$, the performance extraction and analysis section 23 determines that the motion is a "thrust motion" thrusting the motion detecting terminal 5 forward.

Conversely, when the z-axis direction acceleration $\alpha z$ is smaller than the x- and y-axis direction accelerations $\alpha x$ and $\alpha y$, the section 23 determines that the motion is a "cutting motion" cutting through the air with the motion detecting terminal 5. In this case, by further comparing the x- and y-axis direction accelerations $\alpha x$ and $\alpha y$ in value, it is possible to determine whether the direction of the "cutting motion" is "vertical" (x) or "horizontal" (y).

Further, in addition to a comparison of the x-, y-, and z-axis direction components with each other, it is possible to compare the magnitudes of the direction components $\alpha x$, $\alpha y$, and $\alpha z$ themselves with predetermined threshold values and determine that the motion is a "combined motion" combining these motions when the values are above the threshold values. For example, if $\alpha z>\alpha x$, $\alpha z>\alpha y$ and $\alpha x>$"threshold value of x-component", it is determined that the movement is a "vertical (x-axis direction) cutting and thrusting motion", while if $\alpha z<\alpha x$, $\alpha z<\alpha y$, $\alpha x$"threshold value of x-component", and $\alpha y>$"threshold value of y-component", it is determined that the movement is an "obliquely (both x- and y-axis directions) cutting motion". Further, by detecting a phenomenon that the values of the accelerations $\alpha x$, $\alpha y$ in the x and y axis direction are changing relative to each other just like depicting a circular trajectory, it is can be determined that the motion is a "turning motion" which turns the motion detecting terminal 5 round and round.

The performance parameter determining section 24 determines the various performance parameters in accordance with these determination outputs. The musical tone generating section 25 controls the performance data based on the set performance parameters and outputs the musical tones played through the sound speaker system 26. For example, the volume of the music data is controlled in accordance with the absolute value $|\alpha|$ of the acceleration or the largest of the direction components $\alpha x$, $\alpha y$, and $\alpha z$.

Further, the performance parameter determining section 24 controls the other parameters in the following way based on the results of determination of the processing for analysis of the information analyzer 23. For example, the tempo is controlled in accordance with the repetition period of the "vertical (x-axis direction) cutting motion". Apart from this, if the "vertical cutting motion" is a quick and small motion, articulation is applied to the reproduced sound, while if it is a slow and large motion, the pitch is lowered. Further, a slur effect is applied to musical tones to be generated when it is determined that the movement is a "horizontal (y-axis direction) cutting motion". When it is determined that the motion is a "thrust motion", a staccato effect is applied in the same timing by shortening the tone generation duration, or a single tone is inserted (a tone of a percussion instrument, a shout or the like) into musical tones to be generated, according to the magnitude of the motion. When it is determined that the motion is a "combined motion" with a "thrust motion", it applies the above-described types of control in combination. Further, when it is determined that the motion is a "turning motion", and its repetition period is long, an enhanced reverberation effect is applied according to the repetition period, and if its repetition period is short, then, control is provided to generate a trill according to the repetition period.

Note that in addition to the above types of control, the performance parameter determining section 24 provides various types of control, for example, local peak values of the acceleration in the different axes, peak Q-values showing the sharpness of the local peaks, peak intervals showing the time intervals between local peaks, the depths of the valleys between local peaks, the intensities of high frequency components of the peaks, the polarities of the local peaks of the acceleration $\alpha$ (t), etc. are extracted, the beat timing of the music played is controlled in accordance with the time of occurrence of the peaks, the dynamics is controlled in accordance with the local peak values, the articulation AR is controlled in accordance with the peak Q-values, etc.

Further, when carrying out performance or reproduction of music, the musical tone generating system 3 analyzes the detected motion signal transmitted from the motion detecting terminal 5 to determine the performance parameters as described above and controls the musical tone signal generated in accordance with the MIDI data or other music data corresponding to the determined performance parameters. Thus, it becomes possible to perform music reflecting motion of the user carrying the motion detecting terminal 5.

Figure 6:
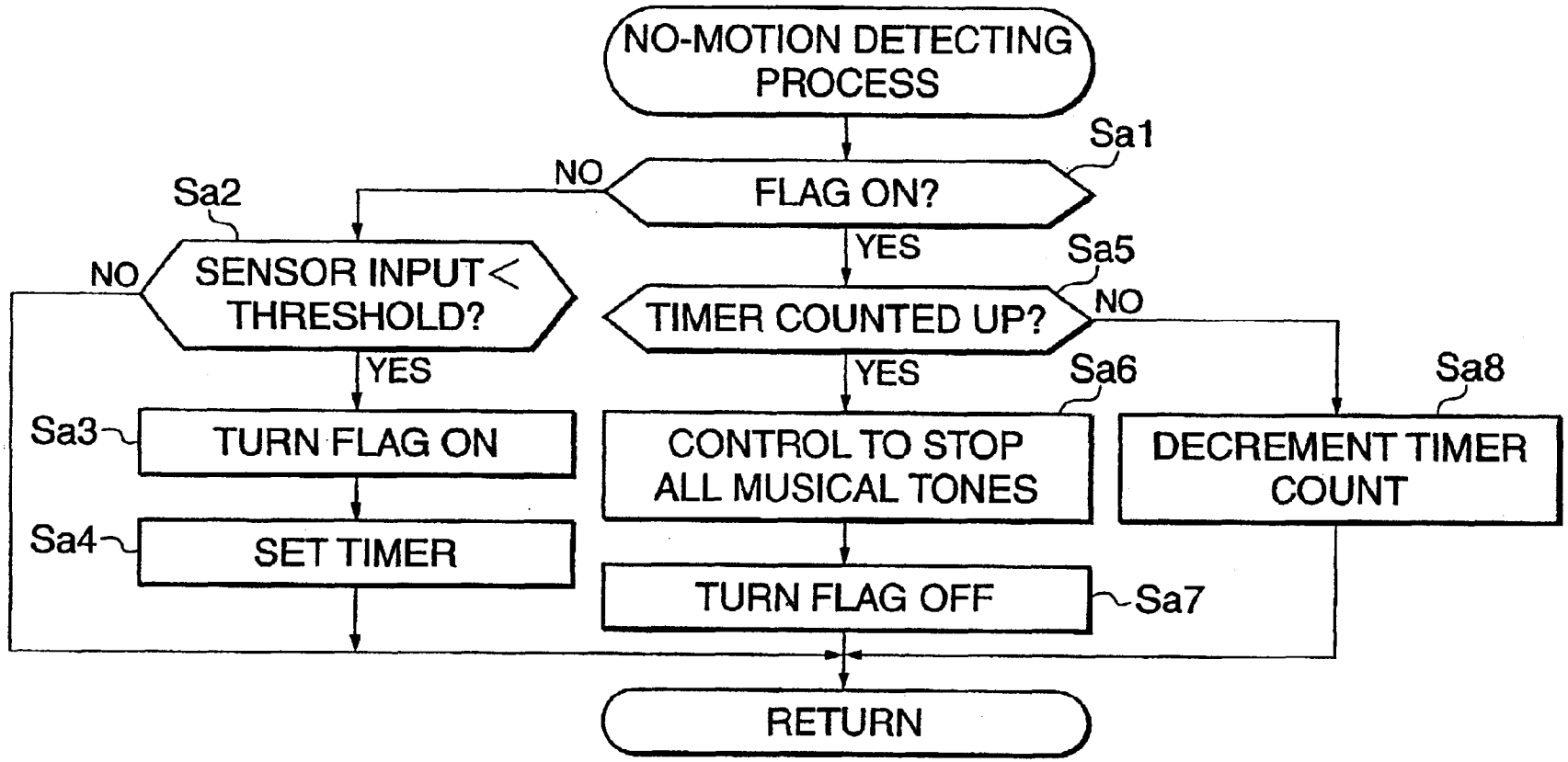
FIG. 6 is a flow chart of a processing routine carried out by the musical tone generating apparatus of FIG. 4 when absence of motion is detected.

While the user carrying the motion detecting terminal 5 is engaged in some motion for performing or reproducing music, the performance parameters corresponding to the motion of the user are determined in the above way and this motion is reflected in the performance or reproduction of the MIDI data or other music data. In such a system performing processing for generation of musical tones corresponding to motion of a user, the user may conceivably stop moving due to fatigue or the like in the middle of performing or reproducing the music. Therefore, the no-motion processor 27 of the musical tone generating apparatus 4 of the musical tone generating system 3 according to the present embodiment determines whether the user is moving based on the detected motion signal supplied from the motion detecting terminal 5 through the radio receiver 22 , and performs control to stop all musical tones currently being generated when determining that the operator is not in the moving state. Next, the processing for detection of the absence of motion executed periodically by the no-motion processor 27 will be described with reference to FIG. 6.

First, it is determined whether a flag indicating whether the user is currently stopping by the detected motion signal from the motion detecting terminal 5 (step Sa1). Here, the flag is set on when a state where the operator is not in the moving state is detected and is set off when a state where he or she is moving is detected. When the flag is on as a result of the determination as to whether the flag is on, the level of the detected motion signal detected and radio transmitted by the motion sensor MS of the motion detecting terminal 5 is compared with a predetermined threshold value (step Sa2). When the level of the detected motion signal supplied from the motion detecting terminal 5 is larger than the threshold value, the processing for detection of absence of motion is ended. On the other hand, when the level of the detected motion signal supplied from the motion detecting terminal 5 is smaller than the threshold value, the flag showing the state of the user moving is set on (step Sa3). Further, the timer is set to a predetermined time period (for example, 0.5 seconds) (step Sa4) and the processing for detecting the absence of motion is ended.

On the other hand, when it is determined that the flag is on as a result of the determination as to whether the flag is on or not at step Sa1, it is determined that the count of the timer is up, that is, if the predetermined time period has elapsed after it was determined that the user was not moving (step Sa5). Here, when the count is up, control information is generated instructing termination of generation of all musical tones currently being generated by the musical tone generating section 25 and this control information is output to the musical tone generating section 25 (step Sa6). As a result, the generation of musical tones by the musical tone generating section 25 is forcibly stopped. Here, when the music player 26 plays back music based on MIDI data, it is possible to have the no-motion processor 27 generate an all-note-off message and output this to the musical tone generating section 25. After the control to stop the generation of all musical tones is carried out in this way, the flag is set off (step Sa7) and the processing for detecting absence of motion is ended.

Further, when the count of the timer is not up as a result of the determination at step Sa5, that is, it is determined that the predetermined time period has not elapsed after it was determined that the user was not moving, the count of the timer is decremented by an amount of one period of the processing for detecting the absence of motion (step Sa8) and the processing for detecting the absence of motion is ended.

Figure 7:
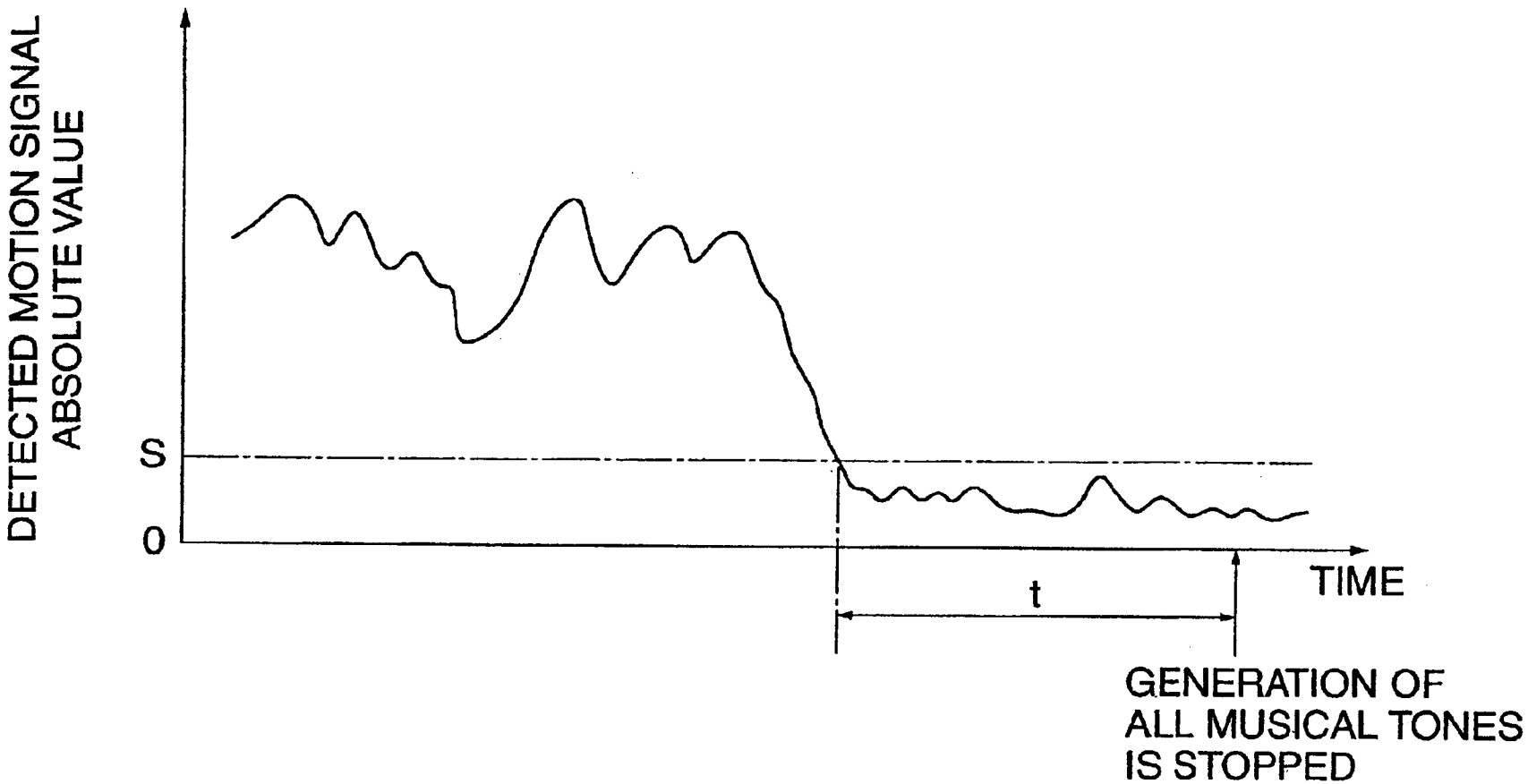
FIG. 7 is a view useful in explaining the processing when the absence of motion is detected in FIG. 6.

The no-motion processor 27 periodically executes this motion absence detecting processing. As a result, when the user carrying the motion detecting terminal 5 stops (or substantially stops) moving for a predetermined time period (for example, 0.5 seconds), it is possible to forcibly stop generation of all musical tones which had been controlled in a manner reflecting the motion of the user up until then. For example, when the absolute value of the level of the output signal of the motion sensor MS of the motion detecting terminal 5 carried by the user changes as shown in FIG. 7, control is performed to stop the generation of all musical tones when the time period in which the absolute value is smaller than the predetermined threshold value S reaches the predetermined time period t.

When the user stops moving for a predetermined time period in this way, the following effects can be obtained by stopping the generation of all musical tones. That is, in a system that performs or plays music based on MIDI data corresponding to motion of the user, when the user stops moving his or her body due to fatigue or the like, a note-off event data is not output for a note already being generated and a musical tone being generated continues to be output as it is, that is, the music is controlled in a manner not according to the user's intention. On the other hand, to prevent such continued generation of a musical tone, it may be considered to stop the generation of all musical tones immediately when the user stops moving, but when the musical composition played includes a portion where a beat timing motion is stopped in the middle or end of music such as "fermata", all musical tones are suddenly stopped automatically and the music played is stopped even though the user has deliberately stopped motion to control the music played, i.e., control is performed in a manner not intended by the user. In contrast, in the present embodiment, the no-motion processor 27 stops generation of all musical tones when the user stops moving for a predetermined time period rather than immediately after the user stops moving. Therefore, it is possible to prevent the generation of musical tones from being continued Regardless of the user stopping motion due to fatigue or prevent the generation of all musical tones from being forcibly stopped regardless of the user temporarily stopping motion deliberately for control of the musical tones, i.e., control from being performed in a manner not according to the user's intention.

It should be noted that the present invention is not limited to the above described embodiments and may be modified in various ways as illustrated below.

In the above embodiment, when it is determined that the user has not moved for a predetermined time period based on the detected motion signal supplied from the motion detecting terminal 5, the generation of all musical tones is stopped, but it may be so arranged that the generation of all musical tones is stopped when the number of times it is determined that the user has not been moving for a predetermined time period reaches a predetermined number (for example, three times). By doing this, even when the user stops moving once due to fatigue, the generation of all musical tones is not stopped and the music continues to be played, and therefore, when the user starts to move again after resting once, it is possible to continue the performance or reproduction of music reflecting the motion. Depending upon the contents of musical compositions, the number of times the user stops moving and rests is large in some musical compositions, and it is small in some musical compositions, Therefore, the above number of times may be set for each musical composition to be played.

Further, in the above embodiment, when it is determined that user has not been moving for a predetermined time period based on the detected motion signal supplied from the motion detecting terminal 5, the generation of all musical tones is stopped, but alternatively, control may be provided to automatically stop the generation of all musical tones after a predetermined time period elapses after the determination is made (in the case of FIG. 7, after the time point when the absolute value of the level of the signal becomes smaller than the threshold value S) regardless of the subsequent motion of the user. In this case as well, it may be so arranged that the generation of all musical tones is stopped when the number of times it is determined that the operator is not in the moving state, that is, the number of times the absolute value of the level of the detected motion signal from the motion detecting terminal 5 becomes smaller than the threshold value S.

Further, in the above embodiment, the generation of all musical tones is stopped when it is determined that the user has not been moving for a predetermined time period based on the detected motion signal supplied from the motion detecting terminal 5, but alternatively the no-motion processor 27 (see FIG. 1) may execute processing to notify or remind the user stopping moving of the fact that he or she has stopped moving without stopping the generation of musical tones. In this case, instead of the control for stopping the generation of all musical tones of step Sa6 of the above processing for detection of absence of motion (see FIG. 6), it is possible to perform various processing for reminding the user of the fact that he or she has stopped moving.

The method for notifying the user of the fact that he or she has stopped moving may include a method of issuing an alarm sound or reproducing audio guidance information of a warning message, to thereby remind the user using his or her auditory sense. When using the auditory sense in this way, it is possible to remind the user by raising or lowering the volume of performance or reproduction of the music based on the MIDI data etc. without providing a separate sound source for warning purposes. Further, it is possible to display a warning message on the display 10*g* of the musical tone generating apparatus 4 or turn on a warning light at the display unit T3 of the motion detecting terminal 5, to thereby remind the user using his or her visual sense. When turning on the display unit T3 of the motion detecting terminal 5 for reminding the user that he or she has stopped moving, it is necessary to provide the motion detecting terminal 5 with a radio reception function and to radio transmit a control signal for generating warning light from the musical tone generating apparatus 4. Further, it is possible to mount a vibration motor etc. in the motion detecting terminal 5 and to radio transmit a control signal from the musical tone generating apparatus 4 to the motion detecting terminal 5 and cause the vibration motor to operate when reminding the user of the fact that motion has stopped, i.e., to remind the user using its sense of touch.

When the user stops moving for a predetermined time period in the above way, it is possible to remind the user of that fact to prompt the user to move to control generation of musical tones. By doing this, it is possible to prevent the generation of all musical tones from being stopped in the instant when the user stops moving, i.e., musical tones from being controlled in a manner not intended by the user. Further, since the generation of musical tones continues, the user can participate in the reproduction of the music again by moving again. For example, by using such a musical tone generating system for rehabilitation etc., it is possible for the person engaged in rehabilitation, that is, the user, to do rehabilitative exercises while enjoying the fun of participating in the reproduction of music. At that time, when the person engaged in the rehabilitation, that is, the user has been stopping exercise for a predetermined time period, the user may be reminded of that fact and prompt him or her to resume exercise.

Further, if this musical tone generating system is used during driving of an automobile or the like, it is possible to perform processing for issuing a warning sound or reproducing information of a warning message when the user (automobile driver) has stopped moving for a predetermined time period so as to keep the user from falling asleep at the wheel.

In this way, when it is determined that the user has not moved for a predetermined time period, it is possible to remind the user of this fact, but as described above with respect to the above variation, it may be so arranged that the user is reminded of the fact that his or her motion has stopped after a predetermined time period elapses after the determination is made (in the case of FIG. 7, when the absolute value of the level of the signal becomes smaller than the threshold value S) regardless of subsequent motion of the user.

Further, the user may be reminded of the fact that his or her motion has stopped when the number of times it is determined that the user has not moved for a predetermined time period reaches a predetermined number (for example, three times).

Further, when motion of the user has stopped for a predetermined time period or when a predetermined time period has elapsed after the determination that motion of the user had stopped, it may be so arranged that the no-motion processor 27 performs control to remind the user of the fact that his or her motion has stopped and to control the musical tone generating section 25 so as to temporarily suspend the generation of all musical tones and then control the musical tone generating section 25 to resume the reproduction of music again when a predetermined time period has elapsed or when the absolute value of the detected motion signal from the motion detecting terminal 5 reaches a level enabling a determination that the user is moving. When the reproduction of music is resumed in this way, the no-motion processor 27 may have only to control the musical tone generating section 25 so that the music is first played at a relatively slow reproduction temp and then the reproduction temp gradually becomes faster from that reproduction temp with the lapse of time. By controlling the reproduction temp in this way, when the user who has once stopped moving due to fatigue or the like starts to move again, the system operates with a slow reproduction temp, that is, it is possible for the user to resume participation in reproduction of music by a slow motion.

Further, in the above embodiment and variations, processing is performed to stop the generation of musical tones or remind the user of the stoppage of motion when motion of the user has stopped for a predetermined time period or when a predetermined time period has passed after motion of the user stopped, but it may be so arranged that the user can select such various control to stop the generation of musical tones or control for notification. For example, the user may select from four modes for execution, that is, a mode for executing control of stopping the generation of all musical tones when it is determined that the user has not moved for a predetermined time period of time as described in the above embodiment, a mode for executing control of automatically stopping the generation of all musical tones after a predetermined time period elapses after the determination that the operator has not moved as described above with respect to Variation 2, a mode for executing control of reminding the user of the fact that the user has not moved for a predetermined time period of time described above with respect to Variation 3 when that fact is determined, and a mode for executing control of automatically reminding the user of the fact that the operator is not in the moving state, after a predetermined time period elapses after that fact is determined. In this case, it may be so arranged that the user can suitably select the on/off state of any desired mode (the states of two or more modes may also be turned on) and perform control corresponding to the selected mode as the processing when the absence of motion is detected. By doing this, it is possible for the user to select various control modes in accordance with the music to be performed.

Further, in the above embodiment, a motion sensor MS comprised of a three-dimensional acceleration sensor or the like acquires a detected motion signal corresponding to motion of the user, output this signal from the motion detecting terminal 5 to the musical tone generating apparatus 4, determines whether the user is moving or not, and controls the generation of musical tones, but in place of this motion sensor MS, it is also possible to use a human body state sensor for detecting the pulse, body temperature, skin resistance, brain waves, breathing, eye movement, and other human body state information and to cause the musical tone generating apparatus 4 to control the generation of musical tones based on the human body state signal detected by this human body state sensor. In this case as well, when the human body state information shown by the human body state signal detected by the human body state sensor is in a predetermined range (for example, the pulse shows a number much greater or much smaller than the normal general number of pulses), in the same way as the above embodiment or various variations, it is possible to stop the generation of all musical tones or issue an alarm or the like to the user. By doing this, when a sign of abnormality or the like is seen in the body of the user wearing the human body state sensor, it is possible to stop the generation of musical tones or issue an alarm to notify the user of that fact and therefore possible to prevent the user from being forced into unreasonable exercise.

Further, in the same way as the above embodiment, it is also possible to use the motion detecting terminal 5 carrying the motion sensor MS to control the generation of musical tones in accordance with the motion of the user and attach the above human body state sensor to the user and stop the generation of musical tones or issue an alarm when the user's motion stops or the human body state information shows a sign of abnormality.

In the above embodiment, the results of detection of the motion sensor MS mounted in the motion detecting terminal 5 are radio transmitted to the musical tone generating apparatus 4, but the invention is not limited to this. The motion detecting terminal 5 and the musical tone generating apparatus 4 may be connected by a signal line or the like and the results of detection of the motion sensor MS may be transmitted through the signal line or the like from the motion detecting terminal 5 to the musical tone generating apparatus 4.

Further, alternatively to forming the motion detecting terminal 5 and the musical tone generating apparatus 4 in separate bodies as in the above embodiment, they may be configured as an integral system.

It is also possible to provide the user with a CD-ROM, floppy disk, or various other storage media storing a program for causing a computer to realize processing of determining the performance parameters, change performance data, and perform reproduction control and processing at the time of detection of the absence of motion, or the user may be provided with the program through the Internet or other transmission media.

While the invention has been described with reference to specific embodiments chosen for purpose of illustration, it should be apparent that numerous variations could be made thereto by those skilled in the art without departing from the basic concept and scope of the invention.

What is claimed is:

1. A musical tone control system comprising:

a motion detecting device capable of being carried by an operator, said motion detecting device generating a detected motion signal corresponding to motion of the operator carrying the device, and transmitting same to an external device;

a musical tone generating device that generates musical tones;

a control device that receives the detected motion signal transmitted from said motion detecting device and controls generation of musical tones from said musical tone generating device based on the received detected motion signal; and a notifying device that notifies a state of the operator;

wherein when said control device determines that the operator is not in a moving state, said notifying device notifies the operator of the determination after a predetermined time period elapses after the determination is made;

wherein said control device is responsive to the notification that the operator is not in the moving state from said notifying device, for performing control to stop the generation of the musical tone from said musical tone generating device, and for performing control to resume the generation of musical tones from said musical tone generating device after a predetermined time period elapses from the stoppage of generation of musical tones; and wherein said control device controls said musical tone generating device so as to gradually raise performance tempo after the resumption of generation of musical tones.

2. A musical tone control system comprising:

a motion detecting device capable of being carried by an operator, said motion detecting device generating a detected motion signal corresponding to motion of the operator carrying the device, and transmitting same to an external device;

a musical tone generating device that generates musical tones;

a control device that receives the detected motion signal transmitted from said motion detecting device and controls generation of musical tones from said musical tone generating device based on the received detected motion signal; and a notifying device that notifies a state of the operator;

wherein when said control device determines that the operator has not been in a moving state for a predetermined time period, said notifying device notifies the operator of the determination;

wherein said control device is responsive to the notification that the operator is not in the moving state from said notifying device, for performing control to stop the generation of musical tones from said musical tone generating device, and for performing control to resume the generation of musical tones from said musical tone generating device after a predetermined time period elapses from the stoppage of generation of musical tones; and wherein said control device controls said musical tone generating device so as to gradually raise performance tempo after the resumption of generation of musical tones.

3. A musical tone control system comprising:

a motion detecting device capable of being carried by an operator, said motion detecting device generating a detected motion signal corresponding to motion of the operator carrying the device, and transmitting same to an external device;

a musical tone generating device that generates musical tones;

a control device that receives the detected motion signal transmitted from said motion detecting device and controls generation of musical tones from said musical tone generating device based on the received detected motion signal;

a notifying device that notifies a state of the operator; and a setting device that sets on/off states of first, second, third, and fourth control modes for controlling said control device and said notifying device;

wherein:

when the first control mode is set on by said setting device, said control device determines whether the operator is in a moving state based on the received detected motion signal, and when determining that the operator is not in the moving state, performs control to stop the generation of musical tones from said musical tone generating device after a first predetermined time period elapses after the determination is made;

when the second control mode is set on by said setting device, said control device determines whether the operator is in the moving state based on the received detected motion signal, and when determining that the operator has not been in the moving state for a second predetermined time period, performs control to stop the generation of musical tones from said musical tone generating device;

when the third control mode is set on by said setting device, said control device determines whether the operator is in the moving state based on the received motion signal, and when determining that the operator is not in the moving state, said notifying device notifies the operator of the determination after a third predetermined time period elapses after the determination is made; and when the fourth control mode is set on by said setting device, said control device determines whether the operator is in the moving state based on the received motion signal, and when determining that the operator has not been in the moving state for a fourth predetermined time period, said notifying device notifies the operator of the determination.

4. A method of controlling a musical tone control system, comprising:

a control step of receiving a detected motion signal transmitted from a motion detecting device capable of being carried by an operator, said motion detecting device generating a detected motion signal corresponding to motion of the operator carrying the device, and transmitting same to an external device, and controlling generation of musical tones from a musical tone generating device based on the received detected motion signal, and a notifying step of notifying a state of the operator;

wherein when in said control step it is determined that the operator is not in a moving state, in said notifying step the operator is notified of the determination after a predetermined time period elapses after the determination is made;

wherein said control step is responsive to the notification that the operator is not in the moving state from said notifying step, for performing control to stop the generation of musical tones from said musical tone generating device, and for performing control to resume the generation of musical tones from said musical tone generating device after a predetermined time period elapses from the stoppage of generation of musical tones; and wherein said control step controls said musical tone generating device so as to gradually raise performance tempo after the resumption of generation of musical tones.

5. A method of controlling a musical tone control system, comprising:

a control step of receiving a detected motion signal transmitted from a motion detecting device capable of being carried by an operator, said motion detecting device generating a detected motion signal corresponding to motion of the operator carrying the device, and transmitting same to an external device, and controlling generation of musical tones from a musical tone generating device based on the received detected motion signal, and a notifying step of notifying a state of the operator;

wherein when in said control step it is determined that the operator has not been in a moving state for a predetermined time period, in said notifying step the operator is notified of the determination;

wherein said control step is responsive to the notification that the operator is not in the moving state from said notifying step, for performing control to stop the generation of musical tones from said musical tone generating device, and for performing control to resume the generation of musical tones from said musical tone generating device after a predetermined time period elapses from the stoppage of generation of musical tones; and wherein said control step controls said musical tone generating device so as to gradually raise performance tempo after the resumption of generation of musical tones.

6. A method of controlling a musical tone control system, comprising:

a control step of receiving a detected motion signal transmitted from a motion detecting device capable of being carried by an operator, said motion detecting device generating a detected motion signal corresponding to motion of the operator carrying the device, and transmitting same to an external device, and controlling generation of musical tones from a musical tone generating device based on the received detected motion signal, and a notifying step of notifying a state of the operator;

wherein:

when a first control mode is set on by a setting device that sets on/off states of the first control mode, and second, third, and fourth control modes for controlling said control step and said notifying step, in said control step it is determined whether the operator is in a moving state based on the received detected motion signal, and when it is determined that the operator is not in the moving state, control is performed to stop the generation of musical tones from said musical tone generating device after a first predetermined time period elapses after the determination is made;

when the second control mode is set on by said setting device, in said control step it is determined whether the operator is in the moving state based on the received detected motion signal, and when it is determined that the operator has not been in the moving state for a second predetermined time period, control is performed to stop the generation of musical tones from said musical tone generating device;

when the third control mode is set on by said setting device, in said control step it is determined whether the operator is in the moving state based on the received motion signal, and when it is determined that the operator is not in the moving state, in said notifying step the operator is notified of the determination after a third predetermined time period elapses after the determination is made; and when the fourth control mode is set on by said setting device, in said control step it is determined whether the operator is in the moving state based on the received motion signal, and when it is determined that the operator has not been in the moving state for a fourth predetermined time period, in said notifying step the operator is notified of the determination.

7. A program for causing a computer to execute a method of controlling a musical tone control system, the method comprising:

a control step of receiving a detected motion signal transmitted from a motion detecting device capable of being carried by an operator, said motion detecting device generating a detected motion signal corresponding to motion of the operator carrying the device, and transmitting same to an external device, and controlling generation of musical tones from a musical tone generating device based on the received detected motion signal, and a notifying step of notifying a state of the operator:

wherein when in said control step it is determined that the operator is not in a moving state, in said notifying step the operator is notified of the determination after a predetermined time period elapses after the determination is made;

wherein said control step is responsive to the notification that the operator is not in the moving state from said notifying step, for performing control to stop the generation of musical tones from said musical tone generating device, and for performing control to resume the generation of musical tones from said musical tone generating device after a predetermined time period elapses from the stoppage of generation of musical tones; and wherein said control step controls said musical tone generating device so as to gradually raise performance tempo after the resumption of generation of musical tones.

8. A program for causing a computer to execute a method of controlling a musical tone control system, the method comprising:

a control step of receiving a detected motion signal transmitted from a motion detecting device capable of being carried by an operator, said motion detecting device generating a detected motion signal corresponding to motion of the operator carrying the device, and transmitting same to an external device, and controlling generation of musical tones from a musical tone generating device based on the received detected motion signal, and a notifying step of notifying a state of the operator;

wherein when in said control step it is determined that the operator has not been in a moving state for a predetermined time period, in said notifying step the operator is notified of the determination;

wherein said control step is responsive to the notification that the operator is not in the moving state from said notifying step, for performing control to stop the generation of musical tones from said musical tone generating device, and for performing control to resume the generation of musical tones from said musical tone generating device after a predetermined time period elapses from the stoppage of generation of musical tones; and wherein said control step controls said musical tone generating device so as to gradually raise performance tempo after the resumption of generation of musical tones.

9. A program for causing a computer to execute a method of controlling a musical tone control system, the method comprising:

a control step of receiving a detected motion signal transmitted from a motion detecting device capable of being carried by an operator, said motion detecting device generating a detected motion signal corresponding to motion of the operator carrying the device, and transmitting same to an external device, and controlling generation of musical tones from a musical tone generating device based on the received detected motion signal, and a notifying step of notifying a state of the operator wherein:

when a first control mode is set on by a setting device that sets on/off states of the first control mode, and second, third, and fourth control modes for controlling said control step and said notifying step, in said control step it is determined whether the operator is in a moving state based on the received detected motion signal, and when it is determined that the operator is not in the moving state, control is performed to stop the generation of musical tones from said musical tone generating device after a first predetermined time period elapses after the determination is made;

when the second control mode is set on by said setting device, in said control step it is determined whether the operator is in the moving state based on the received detected motion signal, and when it is determined that the operator has not been in the moving state for a second predetermined time period, control is performed to stop the generation of musical tones from said musical tone generating device;

when the third control mode is set on by said setting device, in said control step it is determined whether the operator is in the moving state based on the received motion signal, and when it is determined that the operator is not in the moving state, in said notifying step the operator is notified of the determination after a third predetermined time period elapses after the determination is made; and when the fourth control mode is set on by said setting device, in said control step it is determined whether the operator is in the moving state based on the received motion signal, and when it is determined that the operator has not been in the moving state for a fourth predetermined time period, in said notifying step the operator is notified of the determination.

* * * * *